US006099360A

United States Patent [19]

Broschard, III et al.

[11] Patent Number: 6,099,360

[45] Date of Patent: Aug. 8, 2000

[54] CONTACT HAVING A FORCE DISTRIBUTION MEMBER

[75] Inventors: John L. Broschard, III, Hershey; Edmund Luther Jacobs; Jared Joseph Smalley, Jr., both of Harrisburg, all of Pa.

[73] Assignee: The Whitaker Corporation, Wilmington, Del.

[21] Appl. No.: 09/203,984

[22] Filed: Dec. 2, 1998

[51] Int. Cl.[7] ..... H01R 13/432

[52] U.S. Cl. ..... 439/748

[58] Field of Search ..... 439/606, 736, 439/746, 747, 748, 948

[56] References Cited

U.S. PATENT DOCUMENTS

| | | | |
|---|---|---|---|
| 2,689,337 | 9/1954 | Burtt et al. | 439/851 |
| 3,566,342 | 2/1971 | Schmitt et al. | 439/747 |
| 4,448,477 | 5/1984 | Gladd et al. | 439/851 |
| 4,737,117 | 4/1988 | Lockard | 439/92 |
| 4,985,004 | 1/1991 | Zinn | 439/851 |
| 5,209,681 | 5/1993 | Brown | 439/876 |
| 5,695,368 | 12/1997 | Joly et al. | 439/748 |
| 5,716,244 | 2/1998 | Egenolf et al. | 439/843 |
| 5,897,405 | 4/1999 | Endo | 439/852 |

*Primary Examiner*—Steven L. Stephan
*Assistant Examiner*—Barry M-L. Standig

[57] ABSTRACT

An electrical contact having a termination end for terminating with a wire and a contact end for mating with a mating contact. The contact end has a top wall with two top portions with a seam therebetween. One of the top portions has a locking lance to secure the contact within a housing. An engaging member provides interaction between the two top portions to distribute forces from the top portion having the locking lance to the other top portion.

3 Claims, 2 Drawing Sheets

Fig. 3
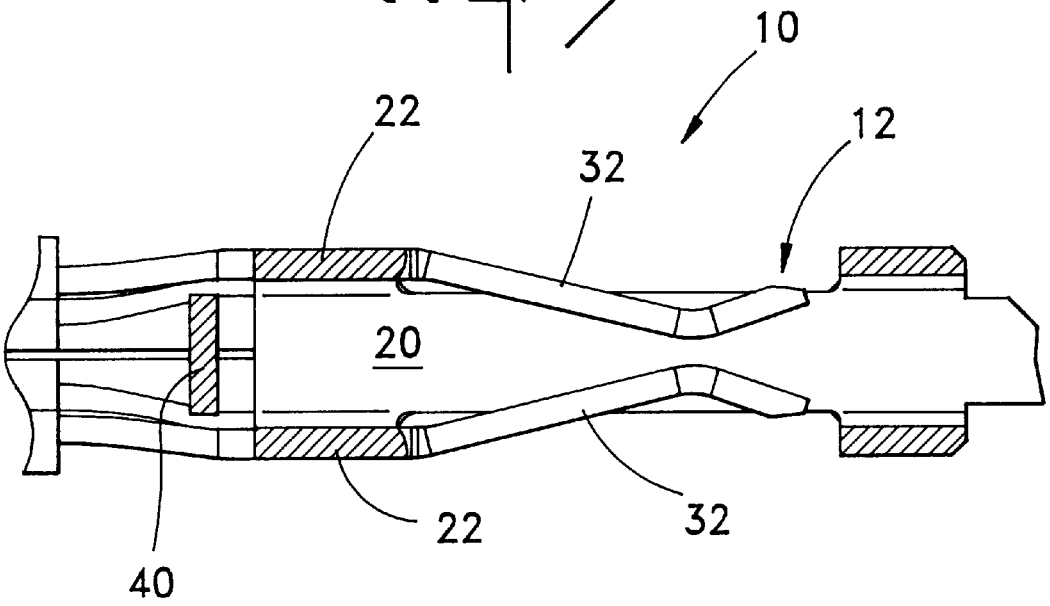
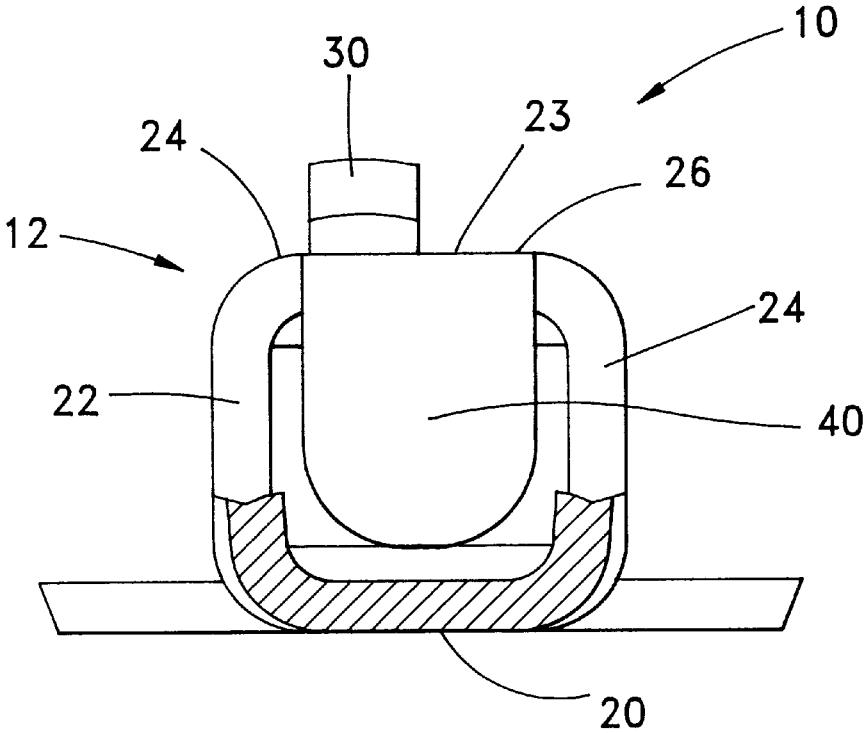
Fig. 4

CONTACT HAVING A FORCE DISTRIBUTION MEMBER

FIELD OF THE INVENTION

The invention is directed to an electrical contact having improved retention within the connector housing. The invention is also directed to an electrical contact to prevent potting material from entering the contact area.

BACKGROUND OF THE INVENTION

Many electrical contacts have lances or locking arms which engage a portion of the connector housing to secure the contact within the housing. When pull out forces are applied to the contact, usually by way of forces on the wire terminated to the contact, a lot of stress is placed on the contact lance or locking arm. At a certain amount of force, the contact lance or locking arm may fail.

What is needed is an improved method for distributing the pull out forces from the locking lance to provide a better strength.

What is also needed is a method for preventing potting material from entering the contact area of the contact or terminal.

SUMMARY OF THE INVENTION

The invention is directed to an electrical contact comprising a termination end for terminating with a wire and contact end for mating with a mating contact. The contact end has a top portion with two top walls With a seam therebetween. One of the top walls has a locking lance to secure the contact within a housing. An engaging member provides interaction between the two top walls to distribute forces from the one of the top walls having a locking lance to the other of the top walls.

The invention is further directed to an electrical connector comprising a wire termination end and a receptacle end, the receptacle end having generally a box shape with an interior space and an outer wall. A flap extends from a rear end of the outer wall to significantly block the interior space from the wire termination end to prevent the flow of potting material from the wire termination end into the interior space of the box shape.

BRIEF DESCRIPTION OF THE DRAWINGS

An embodiment of the present invention will now be described with reference to the accompanying drawings, in which:

FIG. 3 is a cross-sectional view showing the contact mating interface;

FIG. 4 is a cross-sectional view showing the flap on the contact.

DETAILED DESCRIPTION OF AN EMBODIMENT OF THE INVENTION

Figure 1:
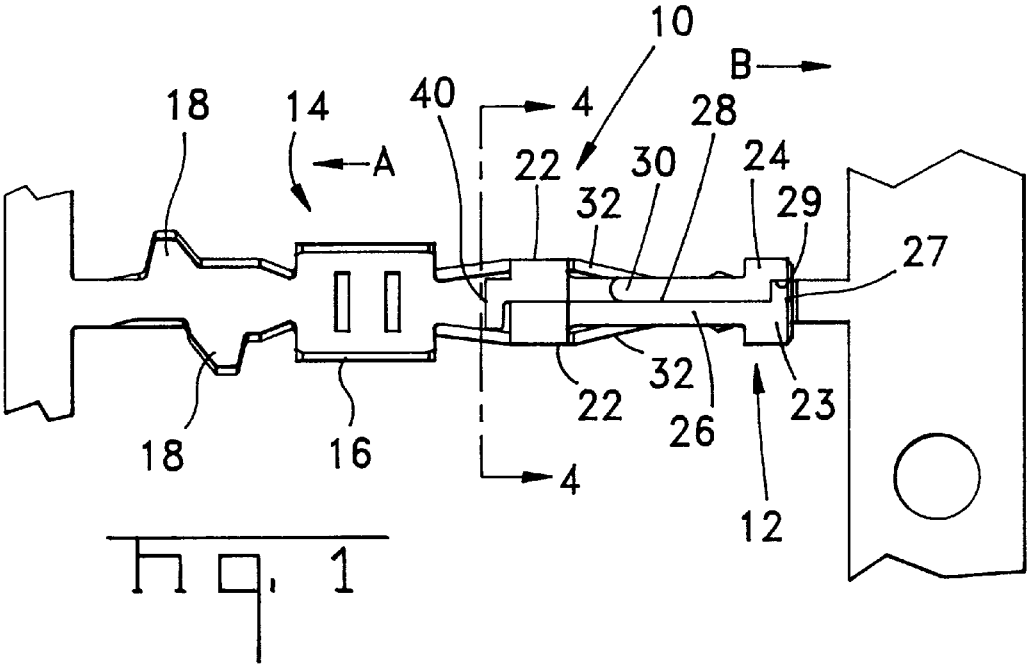
FIG. 1 is a top view of the contact of the present invention attached to a carrier strip.
Figure 2:
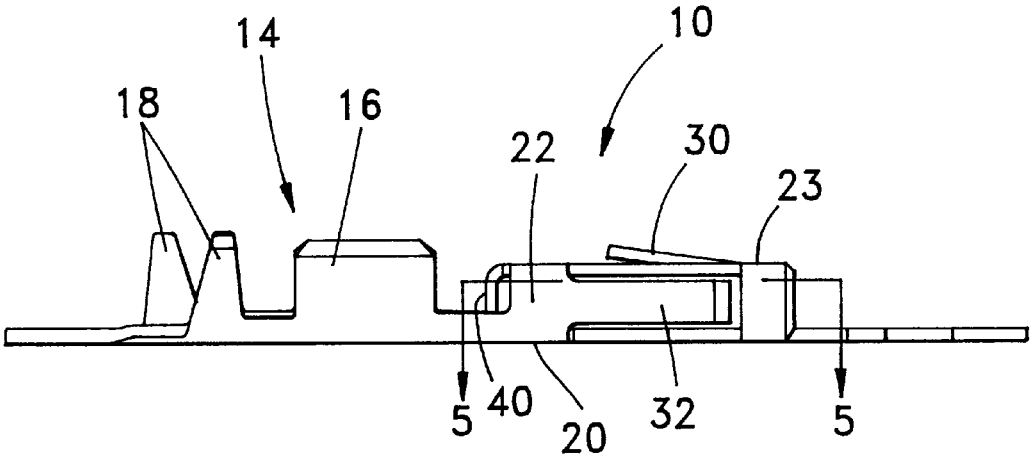
FIG. 2 is a side view of the contact of the present invention.

FIGS. 1 and 2 show a top and side view respectively of an electrical contact 10 of the present invention. The electrical contact 10 is shown attached to the carrier strip from which it is formed. It is to be understood that the contact 10 would be removed from the carrier strip using appropriate methodology prior to use in an electrical connector.

The electrical contact 10 has a receptacle mating end 12 and a wire termination end 14. The wire termination end 14 has a crimp barrel 16 for terminating the conductors on the cable and insulation crimp arms 18. The termination end 14 will be terminated to a wire in a typical manner prior to insertion into a connector housing.

The receptacle mating end 12 of the contact 10 is generally a box shaped type of contact which has a bottom 20, side walls 22, and a top portion 23 which has two top walls 24, 26. A seam 28 runs down the center of the top portion 23 between walls 24, 26, where the walls 24, 26 abut against each other. Top wall 24 has locking lance 30 which extends upwardly from the top portion 23, from top wall 24, to engage a shoulder or opening in the contact housing, not shown, to secure the contact 10 within the contact housing. Along either sidewall 22 are stamped resilient contact fingers 32 which provide a mating interface with a mating contact pin or tab. The resilient fingers 32 both extend inwards toward the center of the box shaped receptacle housing.

The locking lance 30 extends from top wall 24. If pull out forces are exerted in the contact 10, that 1S where the wire which is terminated to the contact 10 is pulled in such a way that the contact 10 is urged backwards, out of the contact housing, the locking lance 30 engages the housing and prevents it from being pulled out. However, if enough force is exerted, the locking lance 30 will buckle thereby allowing the contact 10 to be pulled out of the housing. If the locking lance does not fail, it is possible that the top wall 24, which represents only half of the total top wall, will move forward with respect to top wall 26, thereby disrupting the box shape of the contact 10.

Top wall 26 has tab 27 which extends past the line of the seam 28. Top wall 24 has a complimentary recess 29 into which the tab 27 is received. The tab 27 and the recess 29 provide a section along which the top walls 24, 26 can engage each other. The tab 27 and the recess 29 provide an interlocking mechanism between the two parts of the top walls 24, 26.

The pull out forces are shown in FIG. 1, and are indicated by the direction of arrow A. As pull out forces are exerted on the locking lance 30, the forces tend to push the top wall 24 toward the front end or the receptacle mating end 12, as indicated by arrow B. In the present invention, as the forces are directed in the direction of arrow B, the top wall 24 engages the top wall 26 at tab 27 thereby distributing some of the forces from the top wall 24 to the top wall 26 and providing greater distribution of the forces and therefor greater protection against pull out of the contact 10. A prior art contact would not have tab 27 and would only have a straight seam extending between the top walls 24, 26. In that case, there would be no interaction between the top walls 24, 26 and no distribution of forces.

While the embodiment shown in FIG. 1 shows an engaging member that is a tab 27 and recess 29 to distribute the forces, other methods could be used to distribute the forces, for instance, a keystone can be placed on 24 with a matching inverse shape on 26. Alternatively, there could be two tabs interlocked together or a dovetail. Solder can also be applied to the joint that is formed between 24 and 26 which, when heated, will permanently attach top walls 24 and 26 together. Any type of engagement between the top walls 24, 26 could be used to distribute the forces. While the contact is described as box shaped contact, the invention could be used on other types of contacts which have abutting walls, wherein the locking lance is disposed on one of those abutting walls.

At the rear portion of the top wall 24, extends flap 40, as shown in FIG. 4. Flap 40 extends from the top wall 24 down towards the bottom wall 20 in between the sidewalls 22. While the flap 40 does not completely fill the inner area of the box shaped contact, it significantly covers and blocks that area.

When the contact 10 is used in a contact housing wherein the rear of the contact housing, or the area of the contact housing near the termination end 14 of the contact 10, must be exposed to a potting material, it is necessary to prevent the potting material from entering into the electrical contact area, which in this case, is the receptacle mating end 12. In order to prevent the contamination of the receptacle mating end 12, the flap 40 significantly fills up the area of the box shaped receptacle contact thereby preventing the potting material from seeping forward along the contact from the termination end towards the receptacle end. The flap 40 need not completely close off the area in the receptacle end because the viscosity of the potting material prevents it from flowing through the small openings between the flap 40 and the walls 20, 22 of the box shaped contact. The flap 40 need only significantly slow down the progress of the potting material.

It is felt that the electrical contact of the present invention and many of its attendant advantages will be understood from the foregoing description. It is apparent that varies changes may be made in the form, construction, and arrangement of parts thereof without departing from the spirit or scope of the invention, or sacrificing all of its material advantages.

What is claimed is:

1. An electrical contact, comprising:

a termination end for terminating with a wire and a contact end for mating with a mating contact;

the contact end having a top wall, the top wall having a first portion and a second portion abutting along a longitudinal seam therebetween, the first portion having a locking lance to secure the contact within a housing and a recess at a terminal end of the contact end, and the second portion having a tab extending transversely into the recess.

2. The electrical contact of claim 1, wherein the contact end has a bottom wall and two side walls to form a box shaped structure.

3. The electrical contact of claim 2, wherein the contact end has two resilient contact fingers extending from side walls into the interior of the box shaped contact end.

* * * * *